United States Patent [19]

Behrens et al.

[11] Patent Number: 4,561,792

[45] Date of Patent: Dec. 31, 1985

[54] PAPER TRANSPORTATION DEVICE FOR PRINTERS WHICH USE REEL PAPER, WITH ONE PAPER PRESSURE ROLLER

[75] Inventors: Martin Behrens, Munich; Walter Stöberl, Holzkirchen, both of Fed. Rep. of Germany

[73] Assignee: Siemens Aktiengesellschaft, Berlin and Munich, Fed. Rep. of Germany

[21] Appl. No.: 548,543

[22] Filed: Nov. 3, 1983

[30] Foreign Application Priority Data

Nov. 5, 1982 [DE] Fed. Rep. of Germany ..... 3240914

[51] Int. Cl.[4] ..... B41J 15/16

[52] U.S. Cl. ..... 400/618; 400/619; 400/636.2; 400/637; 400/639; 400/641; 400/708

[58] Field of Search ..... 400/506, 613, 613.3, 400/618, 619, 636, 636.2, 637, 639.1, 641, 647, 708, 708.1, 639; 242/75, 75.2; 226/11, 38, 39, 30, 31, 195

[56] References Cited

U.S. PATENT DOCUMENTS

| | | | |
|---|---|---|---|
| 991,706 | 5/1911 | Dennis | 400/636.2 |
| 1,100,442 | 6/1914 | Phelps | 400/639 X |
| 1,213,189 | 1/1917 | Hart | 400/636.2 X |
| 1,221,236 | 4/1917 | Smith | 400/639.1 X |
| 1,363,294 | 12/1920 | Waldheim | 400/506 |
| 1,539,244 | 5/1925 | Crews | 400/618 |
| 2,142,603 | 1/1939 | Brown et al. | 400/708.1 |
| 2,353,407 | 7/1944 | Kurowski | 400/636 X |
| 3,334,722 | 8/1967 | Bernard | 400/618 X |
| 3,519,117 | 7/1970 | Smith | 400/641 |
| 3,572,601 | 3/1971 | Miller | 400/618 X |
| 3,586,149 | 6/1971 | Miller | 400/618 |
| 3,908,810 | 9/1975 | Denley | 400/613 |
| 4,019,619 | 4/1977 | Emenaker | 400/708 |
| 4,114,750 | 9/1978 | Baeck et al. | 400/618 X |
| 4,197,025 | 4/1980 | Kuelzer | 400/637 X |
| 4,342,521 | 8/1982 | Kuhn | 400/637 |
| 4,354,766 | 10/1982 | Hendrischk et al. | 400/708 |

FOREIGN PATENT DOCUMENTS

| | | | |
|---|---|---|---|
| 253360 | 11/1912 | Fed. Rep. of Germany . | |
| 851069 | 10/1952 | Fed. Rep. of Germany | 400/641 |
| 3014340 | 10/1981 | Fed. Rep. of Germany | 400/636.2 |

OTHER PUBLICATIONS

IBM Technical Disclosure Bulletin, "Paper Out Indicator", Cassell et al., vol. 11, No. 11, Apr. 1969, p. 1482.

IBM Technical Disclosure Bulletin, vol. 9, No. 4, Sep. 1966, p. 415.

IBM Technical Disclosure Bulletin, vol. 17, No. 7, Dec. 1974, pp. 1850–1851, Herriford et al.

*Primary Examiner*—Ernest T. Wright, Jr.

*Attorney, Agent, or Firm*—Karl F. Milde, Jr.

[57] ABSTRACT

The invention relates to a paper transportation device for printers, which use reel paper, having a motor-driven platen and one paper pressure roller which contacts the platen approximately at the center thereof so that it can be swung away in an elastic manner. The paper pressure roller is motor-driven such that the peripheral speed of the paper pressure roller leads the peripheral speed of the platen and by virtue of the arrangement of the paper pressure roller, the maximum possible angle of loop ($\beta$) of the paper and the platen is achieved. This angle is delimited by the paper pressure roller and by a paper guidance channel which is aligned to lead tangentially away from the platen. The paper guidance channel is preceded by a device which produces a bias between the paper and the platen.

15 Claims, 8 Drawing Figures

PAPER TRANSPORTATION DEVICE FOR PRINTERS WHICH USE REEL PAPER, WITH ONE PAPER PRESSURE ROLLER

BACKGROUND OF THE INVENTION

The invention relates to a paper transportation device for printers which use reel paper and which have a motor-driven platen and a paper pressure roller which contacts the platen and can be swung away from it.

German Pat. No. 3,014,340 (corresponding to U.S. Pat. No. 4,342,521) discloses a device for applying pressure to and lifting a paper transportation shaft in paper feeding apparatus. A locking device serves to pivot the paper transportation shaft, which is mounted on one side, away from the platen for the transportation of peripherally perforated paper. When non-perforated sheet or reel paper is used, the transportation shaft, together with the single paper transportation roller applied thereto, are moved into contact with the platen.

In order for the platen and the paper transportation roller to cooperate in slip-free fashion, the paper transportation roller and the platen are operated at the same peripheral speed.

If a paper transportation device of this kind were operated using multi-layer reel paper, the identical peripheral speed of the paper pressure roller and the platen would give rise to dislocations between the various layers of the multi-layer paper. Futhermore, in paper transportation devices of this type additional guide means are required near the paper guide to faciliate accurate insertion and adjustment of the non-perforated paper.

SUMMARY OF THE INVENTION

The object of the invention is a paper transportation device for printers which utilizes single-layer and multi-layer reel paper which ensures exact paper transportation in the region of the printing position and where, when multi-layer paper is used, the individual layers do not become displaced.

In general, the invention features a paper transportation device for printers which use a continuous web of paper supplied from a roll, with a motor-driven platen roller and one paper pressure roller which elastically contacts the platen roller approximately in the center thereof. The paper pressure roller is motor-driven such that the peripheral speed of the paper pressure roller preferably leads the peripheral speed of the platen roller, and the paper pressure roller is arranged to produce as large as possible an angle of loop ($\beta$) of the paper around the platen roller. This angle of loop is delimited by the paper pressure roller and by a paper guidance channel formed by a plate surrounding a portion of the platen roller and which is aligned to lead tangentially away from the platen roller. Finally paper steering means are provided for maintaining tension in, and guiding the web of paper which is passed through the guidance channel and pinched at a nip between the platen roller and the paper pressure roller.

In preferred embodiments, the peripheral speed of the paper pressure roller leads the peripheral speed of the platen by 0.5% to 5.0%; the paper guidance channel further includes a paper trough which is arranged at a fixed distance from the platen; the device which serves to maintain tension and guide the paper comprises a tension adjusting device which includes a spring-mounted wire stirrup with a paper guidance saddle arranged in floating fashion and which is provided with lateral guide elements, and with a wide paper support surface, which elastically contacts the web of paper, having lateral guide elements. The paper guidance saddle includes paper support surfaces of different widths which are bounded by the lateral guide elements, and can be rotatably mounted to be adaptable to paper of different widths. A spring-action paper pressure strip is located beneath the printing position and the paper pressure roller is arranged in the direction of transportation of the platen, either in front of or after the printing position. The paper is guided from a feed roll, via the tension adjusting device, the guide channel and the platen roller, such that the paper is deflected only in the direction of the curvature of the paper which has been pre-impressed by the feed roll. The paper pressure roller is mounted on a paper transportation shaft is stationary at one end and radially mobile at the other. The paper transportation device includes a frame-supported spring wire lever, one arm of which bears the flexibly mounted end of the paper transportation shaft, and the other arm of which is connected to a pivot lever which is rotatable about an axis of rotation, such that, in dependence upon the rotation of the pivot lever, through the torsion of the spring wire body it is possible to vary the force of the paper pressure roller, mounted on the paper transportation shaft, against the platen roller. The paper guidance channel includes a paper-end sensing device for sensing the presence of paper, and an electric warning device linked both to the paper-end sensing device and to the paper transportation shaft so that a warning signal is triggered when the paper transportation shaft is pivoted-away from the platen or when no paper is present; and the paper pressure roller is barrel-shaped and has a cylindrical area of contact with the paper, which area is narrow in relation to the width of the paper pressure roller.

In operation, the various elements of the paper transportation device serve to reliably maintain the alignment of the web of paper as it passes around the platen roller to the print head position.

The fact that the paper is pinched at a single point between the platen roller and the paper pressure roller permits the paper to pivot about this point, thus facilitating a "steering" action which will not be described.

It will be understood that the web of paper is maintained under tension from the pivot point, from where it is positively driven by the platen and pressure rollers, back to some convenient position ahead of to this pivot point, as seen in the direction of paper travel, from which position the paper is laterally guided. If the paper is shifted laterally, or sideways, at this paper guidance position, its direction of travel is varied with respect to the platen roller (i.e., it will be offset by some angle with respect to a line perpendicular to the axis of the platen roller). Consequently, as the paper travels forward at this angle and wraps around the platen roller, it will move sideways on the platen roller toward one end of this roller. It may be seen, therefore, that the position of the paper on the platen roller may be controlled by laterally "steering" the paper from the guidance position.

The fact that the paper pressure roller is motor driven such that the peripheral speed of the pressure roller leads the peripheral speed of the platen, in combination with a paper guidance channel which is aligned to lead tangentially away from the platen, and a device which is mounted in front of the paper guidance channel and which serves to produce a bias between the paper and the platen, all contribute to the production of a paper transportation device which permits the transportation of multi-layer reel paper without disturbing displacements occurring between the layers. The entire paper inlet device is of extremely simple construction but nevertheless an exact guidance of the paper is achieved.

If the device for maintaining tension in the paper consists of a paper guidance saddle which is mounted to float on a spring-mounted wire stirrup and which is provided with a wide paper support surface, then an exact input of the multi-layer paper into the paper supply unit results. The paper tensioning device can readily adapt to the position of the paper roller. An advantage of the wide support surface of the saddle is that it uniformly applies the force of the adjusting stirrup to the paper web. This gentle deflection assists in steadying the paper and reduces the noise of the printer. The saddle guides the paper over a substantial length as a result of which the individual layers hold together more easily. This applies in particular to the use of carbon paper inserts.

If the lateral guide elements of the paper tensioning device consists of elements which can be locked by the paper guidance saddle, the paper guidance saddle can easily be adapted to various paper widths, for which purpose paper support surfaces of different widths can also be arranged on a paper guidance saddle.

A particularly simple guide for the paper transportation shaft is achieved by means of a frame-supported spring wire lever, one arm of which bears the flexibly mounted end of the paper transportation shaft and the other arm of which is connected to the pivot lever. By utilizing the torsion effect of the spring wire lever it is possible to vary the force of the paper pressure roller against the paper transportation roller.

This frame-supported spring wire lever can be combined with a spring stirrup which is arranged in the paper supply unit and which senses the presence of paper. The positions of the two levers may be sensed via a common sensing device. In this way it is possible to sense the paper inlet device both in respect to the rotational state of the paper pressure roller and in respect to the presence of paper in the paper inlet device. This is particularly necessary when the paper inlet device is used within a communications device such as a teleprinter.

Other features and advantages of the present invention will become apparent from the following detailed description, and from the claims.

For a full understanding of the present invention, reference should now be made to the following detailed description and to the accompanying drawings.

DETAILED DESCRIPTION

Figure 1:
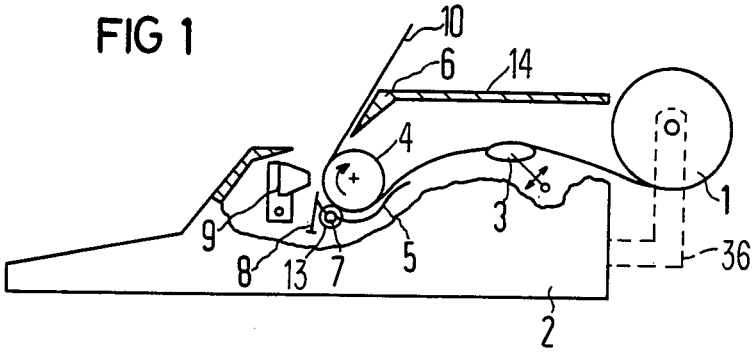
FIG. 1 shows diagrammatically the paper transportation device in a teleprinter.
Figure 3:
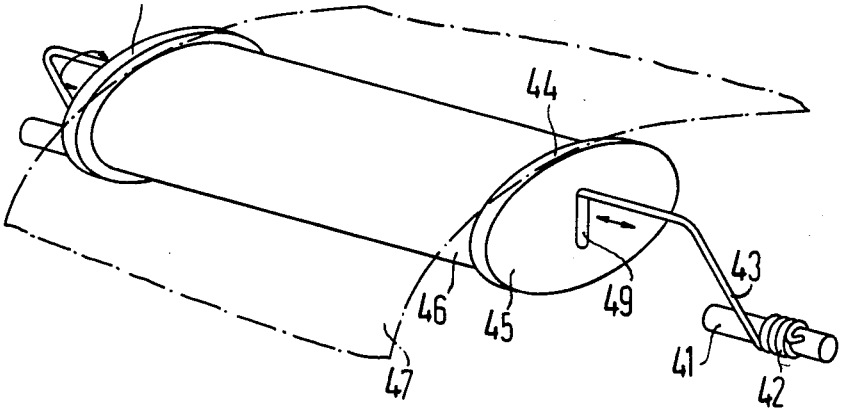
FIGS. 3 to 6 show embodiments of the tension adjusting device used in the paper transportation device.

Referring to FIG. 1, a paper transportation device for a teleprinter is shown. The device includes supply roll 1, for multi-layer reel paper 10, which is rotatably mounted on housing 2 of the teleprinter via mounting brackets 36. Tension adjusting device 3, which will be described later in connection with FIG. 3 consists of a spring-mounted wire stirrup 43 with a paper guidance saddle 45 arranged above it in floating fashion. This tension adjusting device 3 allows the multi-layer reel paper 10 to be fed to a paper guidance channel of the teleprinter. This paper guidance channel is formed by (1) guidance plate 5, which is aligned to lead tangentially away from motor-driven platen 4; (2) paper transportation shaft 7 which is mounted on one side beneath the printing position and is provided with only one pressure roller 13 and (3) elastic paper pressure strip 8 which adjoins paper transportation shaft 7 and extends along the entire width of the platen 4. During printing operation printing head 9 is moved with a conventional drive device (not shown) row-wise along the paper 10 which is clamped over platen 4. The paper transportation, which will be described later in detail, is achieved with friction between motor-driven platen 4 and the pressure roller 13 on the motor-driven paper transportation shaft 7. The printed paper 10 is supported by receiving receptable 6 formed integrally with the cover 14 of housing 2.

Figure 2:
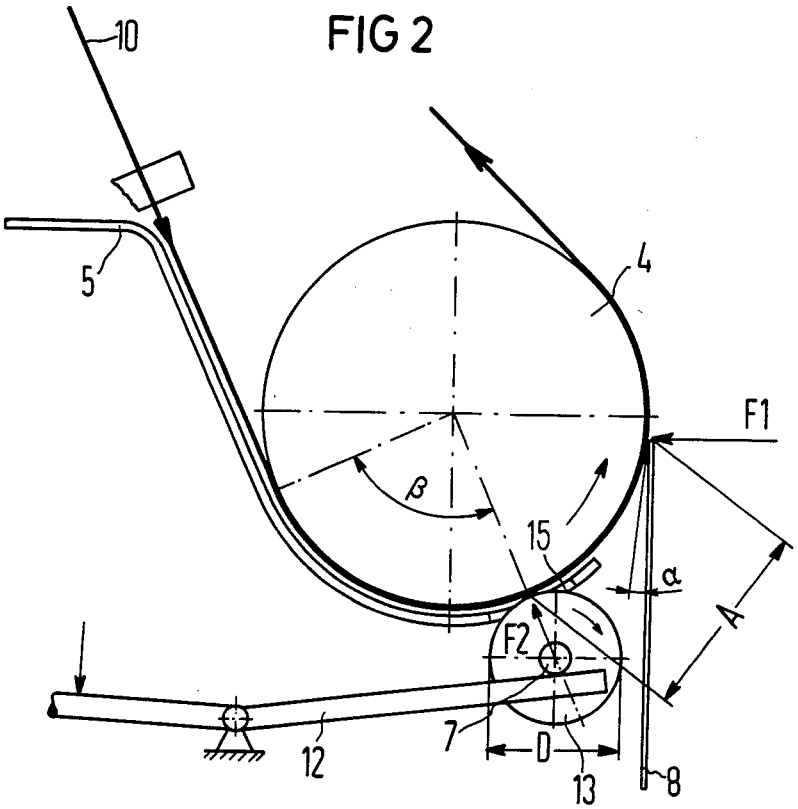
FIG. 2 is a cross-sectional view of the paper transportation device.
Figure 8:
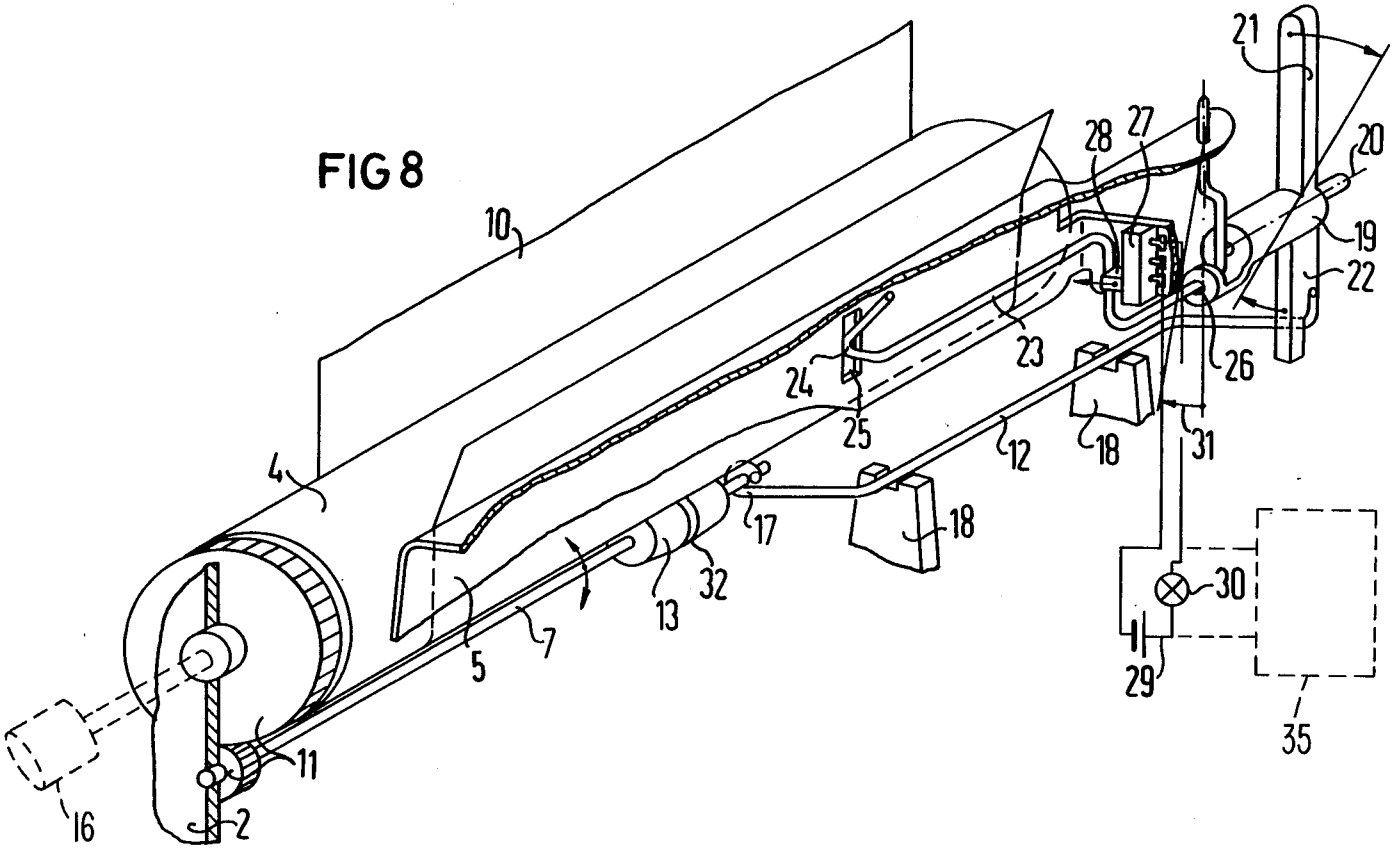
FIG. 8 is a partially cutaway diagrammatic view of the platen area of the paper transportation device with a paper transportation shaft which is guided via a spring lever and whose force against the platen can be varied.

In accordance with FIGS. 2 and 8, the core of the paper transportation device consists of paper transportation shaft 7 which is motor-driven with platen 4 via transmission 11. This shaft 7 is permanently mounted on one side in housing 2, and at its other end is guided by spring stirrup 12 which is fixed to the frame 18. On the paper transportation shaft 7 is arranged paper pressure roller 13 which possesses cylindrical zone 32 that is narrow in relation to the width of the pressure roller 13 and which is in contact with the paper 10. Cylindrical zone 32 tapers into a conical formation on both sides. These conical side elements can alternatively be of barrel formation. The angle $\alpha$ formed by paper pressure strip 8 relative to the tangent of platen 4, and the distance A between paper pressure roller 13 and paper pressure strip 8 at the periphery of platen 4, are selected to be such that even the bend resistance of light paper is sufficient to overcome the force F1 of paper pressure strip 8 without obstructions.

The diameter D of paper pressure roller 13 is suitably dimensioned so that multi-layer paper 10 having a thickness of up to approximately 0.4 mm may be independently picked up and transported. Paper pressure roller 13 itself is arranged beneath the printing position of printing head 9, which is bounded by paper pressure strip 8, to produce as large as possible a looping angle $\beta$ for multi-layer reel paper 10 around platen 4. The large looping angle $\beta$ of approximately 90° around platen 4 which has been represented here, permits considerable variation with regard to the friction value of the platen coating. The central position of barrel-shaped paper pressure roller 13 in recess 15 of paper guidance plate 5, in combination with lateral paper guide elements 44 (FIG. 3) of tension adjusting device 3, produces a "steering" effect which assures the transportation of multi-layer reel paper 10 without dislocations occurring between the layers. In order to achieve this "steering"

effect the rotational speed ratio of platen 4 to paper pressure roller 13 is selected such that a slide advance of 0.5% to 5.0% occurs in respect to the operation of pressure roller 13. This advance, which results from the different peripheral speeds of platen 4 and paper pressure roller 13, limits the loop formation on supply roll 1 and improves the looping around platen 4 in the case of multi-layer paper 10. The degree of the advance is dependent upon the friction pairing of the pressure roller 13 and the paper 10 and in some circumstances can even exceed 5.0%. The force F2 on paper pressure roller 13 is produced by the torsion from frame-supported spring stirrup 12 which is composed of wire. The force F2 can be very small because the rotary movement of paper pressure roller 13 is generated by means of the mechanically driven shaft 7 and is thus independent of friction.

Individually the paper transportation device includes, as shown in FIG. 8, platen 4 which is mounted in housing 2 in such a manner that it is rotatable by means of an electric motor 16. Beneath platen 4 is arranged paper transportation shaft 7 which is linked to the platen 4, via transmission 11 and with barrel-shaped paper pressure roller 13 which is mounted on the paper transportation shaft 7 and rigidly connected thereto. Paper transportation shaft 7, together with paper pressure roller 13, is located at the end of the paper guidance zone delimited by paper guidance plate 5. Shaft 7 is mounted at one end in housing 2 and at is other end in eye 17 of an arm of frame-supported spring stirrup 12 so that it is rotatable in accordance with the arrow shown. Depending upon the paper 10 which is used (reel paper, multi-layer paper, individual sheets) paper pressure roller 13 can be pressed, via spring stirrup 12, with more or less force against platen 4 and interlying paper 10. For insertion and adjustment it is also possible to totally pivot paper pressure roller 13 out of the way. For this purpose the spring stirrup 12, which is mounted in guide 18 so that it is fixed to the frame, is actively connected by its other arm to pivot lever 19 which is, in turn, mounted so that it is rotatable about axis 20.

The pivot lever 19 consists of handle 21 with attachment 22 arranged beneath the handle 21. In the represented state of paper pressure roller 13, under the torsion effect of spring stirrup 12, one end of this stirrup 12 is in contact with this attachment 22. By pivoting pivot lever 19 in accordance with the direction of the arrow, the pressure roller 13 can be pivoted away from platen 4.

In order to detect the presence of paper 10 around the platen 4 sensing spring stirrup 23 is provided. At its looped sensing end 24, sensing spring stirrup 23 passes through an opening 25 in paper guidance plate 5 and rests on platen 4. Sensing spring stirrup 23 is multiply curved and is located at its outer, sensing end 24 in recess 25 of paper guidance plate 5. Sensing spring stirrup 23 is guided by guide component 26 which forms part of pivot lever 19 and is arranged eccentrically relative to the axis of rotation 20 of lever 19. That part of sensing spring stirrup 23 located opposite the sensing end 24 is U-shaped and contacts an electric sensing device 27 which may be a switch. The cooperation between sensing stirrup 23, electric sensing device 27 and spring stirrup 12 is as follows: If the paper guide contains a piece of paper 10, sensing end 24 and thus sensing spring stirrup 23 are lifted from platen 4. Pivot lever 19 now occupies the represented base position in which a force is applied against paper pressure roller 13. Sensor 28 of electric sensing device 27 is in contact with the central component of the sensing stirrup 23. In the illustrated state in which paper 10 is inserted, the electric sensing device 27 is actuated, and therefore switch contacts contained in the electric sensing device 27 are placed in their open position. These open switch contacts interrupt a circuit composed of voltage source 29 and warning lamp 30, so that warning lamp 30 is turned-off. Naturally, electric sensing device 27 can also be connected to a central microprocessor 35 of the printer which controls the operating states (on-off) in dependence upon the sensing device 27.

When paper 10 has passed through the paper guide, as a result of its spring characteristics the sensing spring stirrup 23 contacts platen 4 in accordance with the arrow shown. As a result sensor 28 is likewise moved in accordance with the arrow and the warning circuit is closed, so that warning lamp 30 is illuminated.

This illumination of the warning lamp 30 also occurs when pivot lever 19 is moved according to the arrow in order to pivot the paper transportation shaft 7. As a result of this movement, via eccentric guide component 26 sensing spring stirrup 23 is pivoted by angle 31 which again results in the closure of the warning circuit and thus the illumination of warning lamp 30. Therefore, it is possible to use electric sensing device 27 both to sense the the presence of paper 10 in the paper guide and to sense the rotational state of the paper pressure roller 13.

Figure 5:
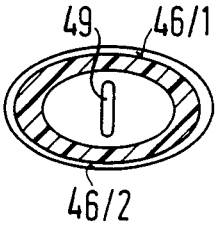
Figure 4:
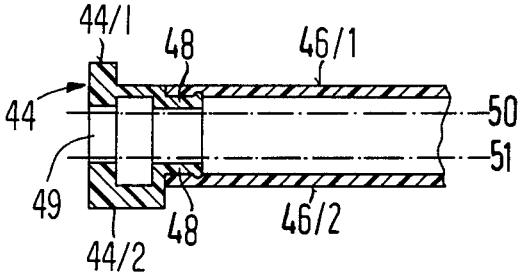

Tension adjusting device 3 (shown in FIG. 3), which is provided to produce a bias of multi-layer reel paper 10 between supply roll 1 and platen 4, consists of spring stirrup 43 which is spring-mounted on axle 41 by means of a helical section 42, and upon which paper guidance saddle 45 which possesses lateral guide elements 44 and wide paper support surface 46, is mounted in floating fashion, so that it is laterally displaceable. Paper support surface 46 guides and centers multi-layer reel paper 47. In order to be able to easily adapt the paper guidance saddle 45 to multi-layer reel paper 10 of various widths, lateral guide elements 44 are connected to the paper support surfaces 46/1 and 46/2 via locking elements 48 so as to be exchangable. Here the paper guidance saddle 45 is designed to be tubular in accordance with the sectional diagram in FIG. 5. It is also provided with several paper support surfaces 46/1 and 46/2. The corresponding adaptation of the paper guidance saddle 45, provided with two paper support surfaces 46/1 and 46/2, with their associated lateral edges 44/1 and 44/2, to the corresponding width of the multi-layer reel paper 47 is effected by simply rotating paper guidance saddle 45 about wire stirrup 43. When this occurs wire stirrup 43 slides in longitudinal guide opening 49 in accordance with FIG. 4 its axis changes from position 50 to position 51 or vice versa. This means that the paper width adjustment is effected by simply rotating paper guidance saddle 45 by 180°. By virtue of its own weight and the spring action of the helical section 42 of the stirrup 43, paper 47 resting on paper guidance saddle 45, ensures that the paper guidance saddle 45 cannot turn during operation.

Figure 6:
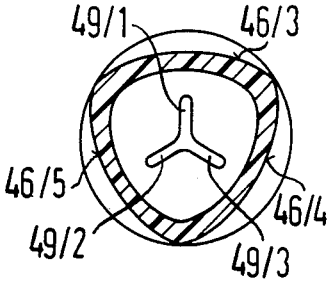

If, as shown in FIG. 6, central guide opening 49/1, 49/2, 49/3 for wire stirrup 43 is star shaped, three paper support surfaces 46/3, 46/4 and 46/5 of different widths can be arranged on the periphery of paper guidance saddle 45. When a change-over is made between the individual paper support surfaces 46/3, 46/4, 46/5, the wire stirrup 43 is brought into position 49/1, 59.2 or 49/3.

Figure 7:
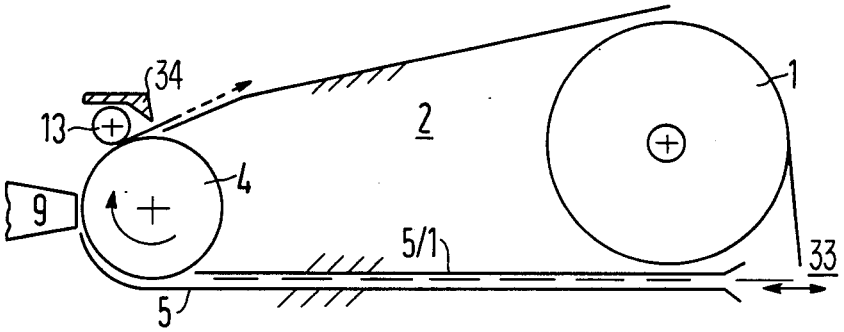
FIG. 7 shows diagrammatically a paper transportation device with a paper pressure roller arranged above the printing position.

A particularly advantageous and simple design of the paper inlet device is achieved if, in accordance with FIG. 7, motor-driven paper pressure roller 13 is arranged above the printing head 9, such as in the direction of feed behind the printing position. This produces a particularly simple looping together with a uniform contact between paper 10 and the platen 4. As a result of the large loop the force of pressure roller 13 can be even further reduced so that even the finished paper 10 provided with carbon inserts can be transported through the paper transportation device without traces of pressure marks. Tension adjusting device 33 (shown in FIG. 7), in association with a funnel-shaped paper supply channel composed of lateral guide plate 5 and a counter-plate 5/1 which can consist, for example, of a housing wall, lead to particurlary careful treatment of the multi-layer 10. The curvature of the multi-layer paper 10 which is pre-impressed by paper roll 1 is retained during passage through the paper inlet device and thus through the entire printer. This standardized guidance of the multi-layer reel paper 10 through the overall printer results in a particularly good adjustment of the individual layers of the multi-layer reel paper 10 relative to one another and thus in an entirely uniform row line-up. The entire printer can be of a particularly compact construction. To allow the reel paper 10 to be torn off, cutting edge 34 can be located above paper pressure roller 13 so that by virtue of its closeness to paper pressure roller 13, a particularly simple and precise separation of the printed reel paper 10 is possible.

There has thus been shown and described a novel paper transportation device for printers which use reel paper, with one paper pressure roller, which fulfills all the objects and advantages sought. Many changes, modifications, variations and other uses and applications of the subject invention will, however, become apparent to those skilled in the art after considering this specification which discloses embodiments thereof. All such changes, modifications, variations and other uses and applications which do not depart from the spirit and scope of the invention are deemed to be covered by the invention which is limited only by the claims which follow.

What is claimed is:

1. A paper transportation device for printers using a continuous web of paper supplied from a feed roll, said device comprising:

(a) a platen roller;

(b) a single, barrel-shaped paper pressure roller arranged to elastically contact said plater roller at approximately the center thereof;

(c) means for driving said platen roller and said paper pressure roller such that the peripheral speed of said paper pressure roller is at least as great as that of said platen roller;

(d) a paper guidance plate surrounding a portion of said platen roller and forming a guidance channel therewith, said paper guidance plate extending from approximately the position of said paper pressure roller around said platen roller with as large as possible an angle of loop; and (e) paper steering means, arranged ahead of said platen roller as seen in the forward direction of paper travel, for maintaining tension in, and laterally guiding said web of paper which is passed through said guidance channel and pinched at the nip between said platen roller and said paper pressure roller.

2. The paper transportation device of claim 1, wherein said paper guidance platen leads tangentially away from said platen roller at the position where said paper first contacts said platen roller.

3. The paper transportation device of claim 1, wherein the peripheral speed of said paper pressure roller leads the peripheral speed of said platen roller.

4. The paper transportation device of claim 1, wherein said angle of loop is approximately 90 degrees.

5. The paper transportation device of claim 3, wherein the peripheral speed of the paper pressure roller leads the peripheral speed of the platen roller by 0.5% to 5.0%.

6. The paper transportation device of claim 1, wherein said paper steering means comprises a paper trough which is arranged at a fixed distance from the platen roller.

7. The paper transportation device of claim 1, wherein said paper steering means includes a spring-mounted wire stirrup with a paper guidance saddle arranged in floating fashion and which is provided with lateral guide elements, an with a wide paper support surface which elastically contacts the web of paper.

8. The paper transportation device of claim 7, wherein the lateral guide elements comprise elements which can be locked in the paper guidance saddle.

9. The paper transportation device of claim 7, wherein the paper guidance saddle comprises paper support surfaces of different widths which are bounded by the lateral guide elements, said saddle being rotatably mounted so as to selectively present support surfaces of different widths to the paper.

10. The paper transportation device of claim 1, further comprising a print head arranged adjacent said platen roller a spring-action paper pressure strip arranged beneath said print head, wherein the paper pressure roller is arranged ahead of said print head in the forward direction of paper travel.

11. The paper transportation device of claim 1, further comprising a print head arranged adjacent said platen roller wherein the paper pressure roller is arranged after said print head in the forward direction of paper travel.

12. The paper transportation device of claim 1, wherein the paper is guided from said feed roll via the paper guidance channel and the platen roller, such that the paper is deflected only in the direction of the curvature of the paper which has been pre-impressed by the feed roll.

13. The paper transporation device of claim 1, wherein the paper pressure roller is mounted on a transportation shaft having one end which is radially stationary and one end which is radially mobile, and said paper transportation device further comprises a frame-supported spring wire lever, one arm of which bears the flexibly mounted end of said paper transportation shaft and the other arm of which is connected to a pivot lever which is rotatable about an axis of rotation, such that, in dependence upon the rotation of the pivot lever and through the torsion of the spring wire lever, it is possible to vary the force of the paper pressure roller, mounted on the paper transportation shaft, against the platen roller.

14. The paper transportation device of claim 1, wherein the paper pressure roller is mounted on a paper transportation shaft and said paper transportation device further comprises a paper supply zone which includes a paper-end sensing device for sensing the presence of paper, and an electric warning device linked both to the paper-end sensing device and to the paper transportation shaft so that a warning signal is triggered when the paper transportation shaft is pivoted away from the platen roller or when no paper is present.

15. The paper transportation device of claim 1, wherein the barrel-shaped paper pressure roller has a cylindrical area of contact with the paper, which area is narrow in relation to the width of the paper pressure roller.

* * * * *